US006644074B2

(12) United States Patent
Mönig

(10) Patent No.: US 6,644,074 B2
(45) Date of Patent: Nov. 11, 2003

(54) KIT FOR AN EXTERNAL DOOR HANDLE, IN PARTICULAR FOR VEHICLES

(75) Inventor: Stefan Mönig, Schwelm (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 0 days.

(21) Appl. No.: 10/156,773

(22) Filed: May 28, 2002

(65) Prior Publication Data

US 2002/0178770 A1 Dec. 5, 2002

(30) Foreign Application Priority Data

May 29, 2001 (DE) ..... 101 26 045

(51) Int. Cl.[7] ..... G05G 5/00; E05B 13/10

(52) U.S. Cl. ..... 70/208; 292/336.3; 292/DIG. 53; 292/DIG. 64; 70/DIG. 31; 70/224

(58) Field of Search ..... 70/207, 208, 209, 70/215, 224, 466, DIG. 31; 292/DIG. 64, DIG. 31, DIG. 53, 336.3

(56) References Cited

U.S. PATENT DOCUMENTS 4,438,964 A * 3/1984 Peters ..... 292/216
5,123,687 A * 6/1992 Pfeiffer et al. ..... 292/336.3
6,401,302 B1 * 6/2002 Josserand et al. ..... 16/444
6,447,030 B1 * 9/2002 Meinke ..... 292/347
6,471,262 B1 * 10/2002 Schwab ..... 292/336.3
6,543,090 B2 * 4/2003 Muneta ..... 16/412
2002/0124607 A1 * 9/2002 Hubner ..... 70/208

FOREIGN PATENT DOCUMENTS

| | | |
|---|---|---|
| DE | 3030519 | 1/1983 |
| DE | 3343443 | 6/1985 |
| DE | 4446904 | 2/1996 |
| DE | 197 24 572 C1 | 10/1998 |
| DE | 200 16 108 U1 | 2/2001 |
| DE | 199 40 379 A1 | 4/2001 |

* cited by examiner

*Primary Examiner*—Anthony Knight
*Assistant Examiner*—John B. Walsh
(74) *Attorney, Agent, or Firm*—Friedrich Kueffner

(57) ABSTRACT

A kit for an external vehicle door handle has a carrier fastened at an inner side of a door panel and a handle mounted on the carrier from the exterior of the door. The carrier has a pivotable bearing arm with a coupling receptacle and the handle has a shaft end with a coupling plug engaging the coupling receptacle of the bearing arm during mounting of the handle. A locking device accessible through a hole in a door folding secures in a locking position the coupling plug and the coupling receptacle for coupling the handle and the bearing arm. The bearing arm has a spring-loaded locking member with a locking location and the coupling plug has a matching counter locking location. The locking device has an adjustable obstacle projecting into the restoring path of the locking member and locking the locking member engaging the counter locking member.

14 Claims, 6 Drawing Sheets

KIT FOR AN EXTERNAL DOOR HANDLE, IN PARTICULAR FOR VEHICLES

BACKGROUND OF THE INVENTION

1. Field of the Invention

The invention relates to a kit for an external door handle, in particular, for vehicles, comprised of a carrier to be fastened at the inner side of the door on an exterior door panel and of a handle which is mounted from the exterior of the door on the mounted carrier, wherein the handle, after having been mounted, is pivotably supported on the carrier and has at one end of the handle a shaft which can be pushed through a cutout in the exterior door panel. Accordingly, the kit is comprised of two initially separate modular units, i.e., a carrier to be fastened on the inner side of the door and a handle. After attachment of the carrier, the handle is mounted from the exterior side of the door on the carrier and maintains a pivotable support relative to the carrier. One end of the handle is provided with a shaft which can be pushed during mounting through a cutout in the door panel.

2. Description of the Related Art

In a known kit of this kind (German patent 30 30 519 C2), the handle is a pull handle and is pivotably supported on the carrier with its end opposite the shaft. The shaft of the mounted handle penetrates the attached carrier and cooperates with lock levers provided on the inner side of the door.

It has already been suggested (German patent application 199 40 379 A1, unpublished) to use also the shaft for supporting the handle on the carrier. In this case, the handle is connected by two bearings on the carrier and, after having been mounted, is foldable relative to it about a horizontal or slanted axis. For this purpose, the carrier is connected with a bearing arm connected thereto in a pivotable way thus forming a modular unit. The bearing arm is comprised of a coupling receptacle for a coupling plug provided on the end of the shaft. In the engagement area between the coupling receptacle and the coupling plug a locking means is provided which is accessible through a hole in the door folding. In the locking situation, the coupling engagement is secured, and an unwanted demounting is prevented in this way.

In some applications, components are located in the coupling area between the end of the handle shaft and the bearing arm which make the locking means inaccessible. Such components can be, for example, a lock cylinder in the carrier or blind inserts used in place of it. In this case, the advantageous mounting by coupling between the handle shaft and the bearing arm on the carrier cannot be employed.

SUMMARY OF THE INVENTION

It is an object of the present invention to develop a universally usable kit which makes possible such a mounting by coupling also in the aforementioned unfavorable situations without any problems.

In accordance with the present invention, this is achieved in that, for supporting the handle, the carrier already has a pivotable bearing arm with a coupling receptacle; in that the shaft end of the handle is formed as a coupling plug engaging during mounting of the handle the coupling receptacle of the bearing arm; in that in the coupling area of the coupling plug and of the coupling receptacle a locking device is arranged which is accessible through a hole in the door folding of the exterior door panel and which secures the coupling engagement in the locking situation; in that on the bearing arm a movable locking member is arranged which is spring-loaded and has a locking location; in that the coupling plug has a counter locking location for the locking member on the shaft end of the handle; and in that the locking device is comprised of an adjustable obstacle which in the locking situation of the coupling projects into the restoring path of the locking member and locks the locking member in its locking engagement in the coupling plug.

This locking device of the locking means can be arranged at a spacing from the coupling locations. A spacing is selected which is sufficiently large in order to ensure access from a lateral hole in the door folding. In this way, obstacles in the area of the carrier, for example, the lock cylinder, can no longer impair access to the locking device. Advantageously, the locking means can be configured as follows.

According to the invention, the coupling engagement between the shaft end of the handle and the bearing arm of the carrier is pre-secured by locking means which during coupling and decoupling produce locking forces that can be easily overcome and which preliminarily determine the defined coupling position. This preliminary coupling position can be locked by an obstacle which blocks the locking movement of the locking means occurring during the coupling and decoupling action after completed coupling.

These locking means are comprised of a locking member which is moveably arranged on the bearing arm and spring-loaded. The locking member, in the coupling situation, projects with its locking location into a counter locking location which is provided in the area of the coupling plug. Accordingly, it is only required to move the aforementioned obstacle into the restoring path of the locking member in order to lock the locking engagement of the locking member in the coupling plug.

Further features and advantages of the invention will be disclosed in the following with the aid of the drawings.

DESCRIPTION OF THE PREFERRED EMBODIMENTS

Figure 3:
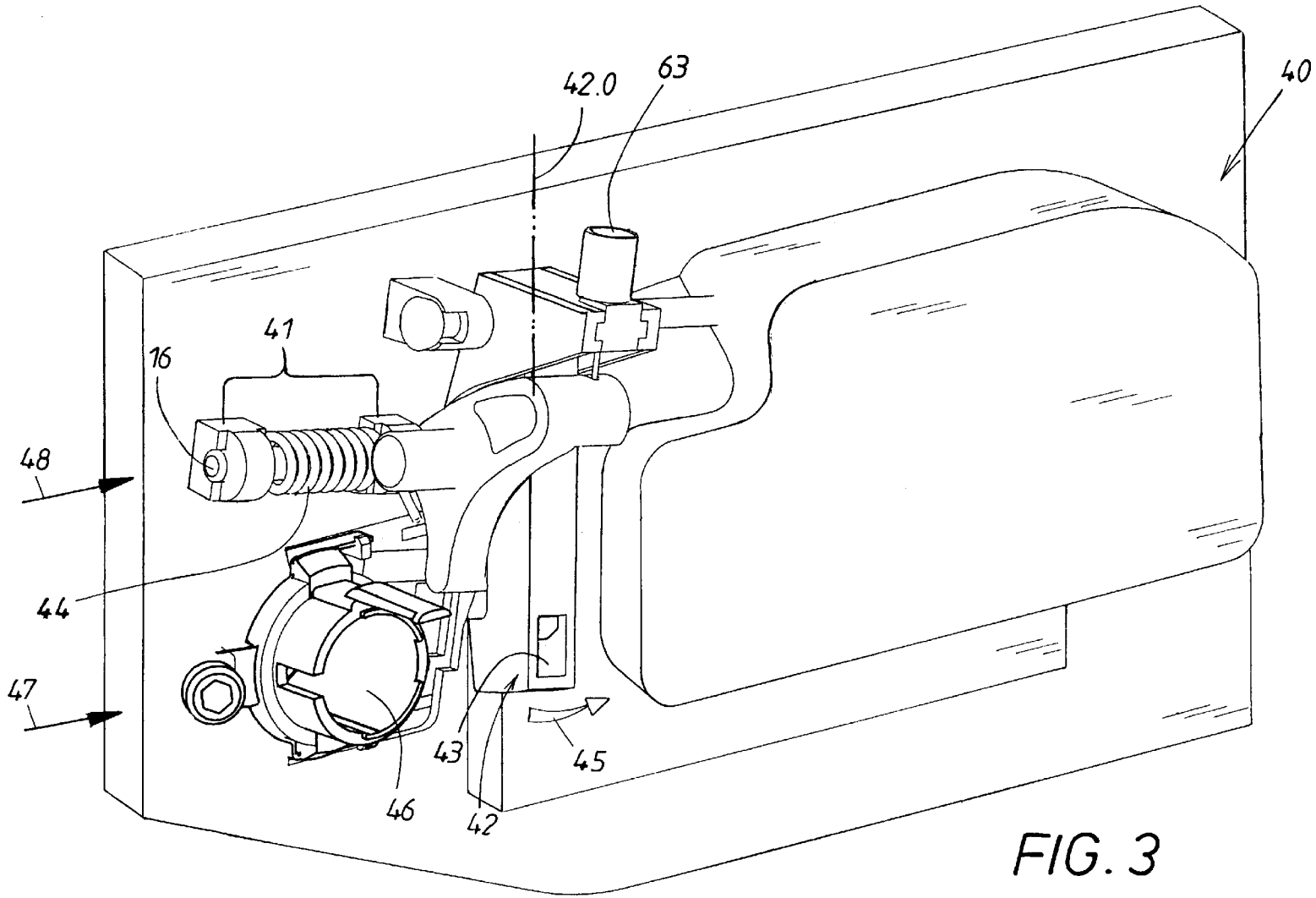
FIG. 3 shows a rearview of a carrier correlated with the modular unit of FIGS. 1 and 2 before its attachment on the inner side of the outer door panel.
Figure 4:
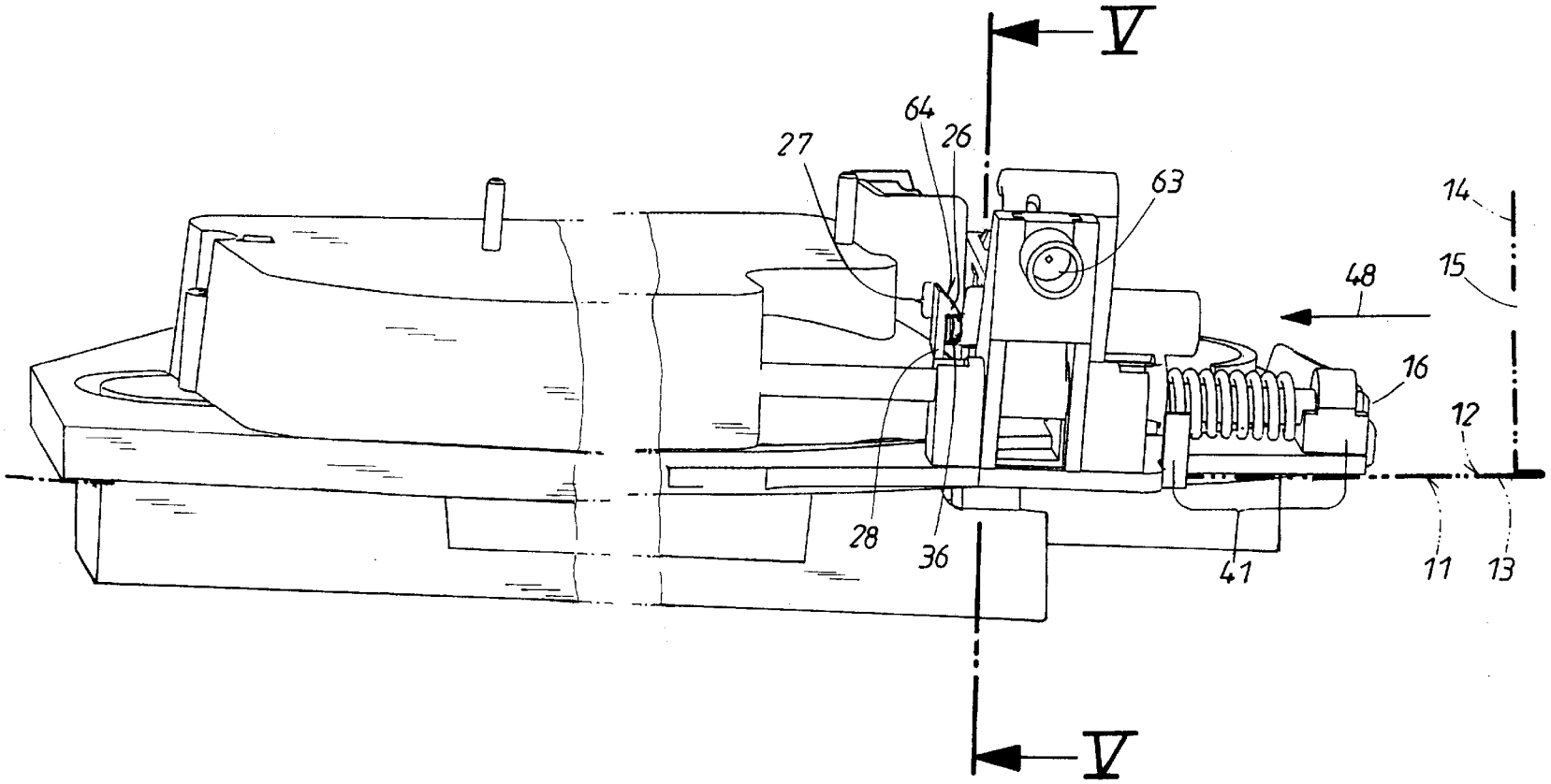
FIG. 4 shows in a slightly perspective plan view, which is broken away for space considerations at the center, the two modular units of FIGS. 1 and 2 and of FIG. 3 after completed assembly wherein the extension of a door panel positioned therebetween is illustrated as a dash-dotted line.

The kit for an external door handle comprises a pre-mounted modular unit 10 which is to be mounted from the exterior side 11 of the door on a door panel 13 illustrated schematically in FIG. 4. On the oppositely located inner side 12 of the door a carrier 40, shown in FIG. 3, has been attached previously which is also a modular unit of several pre-mounted elements of which only the most important ones will be mentioned.

This modular carrier unit 40 comprises a first spring-loaded bearing 41 for a bearing arm 42 pivotably supported thereat. The bearing arm 42 has a coupling receptacle 43. A restoring spring 44 provided in the area of the bearing 41 provides spring loading 45 of the bearing arm 42 in the direction of force arrow 45 of FIG. 3. The pivot movement of the bearing arm 42 can be limited by end stops, not illustrated in detail. For simplifying the drawings, the position 42.0 of the bearing arm 42 is illustrated in FIG. 3 which characterizes the rest position of a handle 20 belonging to the other modular unit 10.

The modular unit 10 comprises a recessed shell 30 which extends in the manipulation area 21 of the handle 20 which is pre-mounted thereon. The recessed shell 30 covers in the mounted situation a cutout, not shown in detail, of the outer door panel 13 and assumes at the exterior side 11 of the outer door panel 13, which is illustrated in a dash-dotted line in FIG. 9, a flush position with the carrier 40. This flush position of the recessed shell 30 is secured relative to the carrier 40 by holding means, not illustrated. The recessed shell 30 is covered by a cover 31 which extends in conformity with the handle 20 and has a penetration 33. After mounting, this penetration 33 is aligned with a lock cylinder, not illustrated in detail, which is mounted in a cylinder receptacle 46 of the carrier 40, illustrated in FIG. 3.

Figure 6:
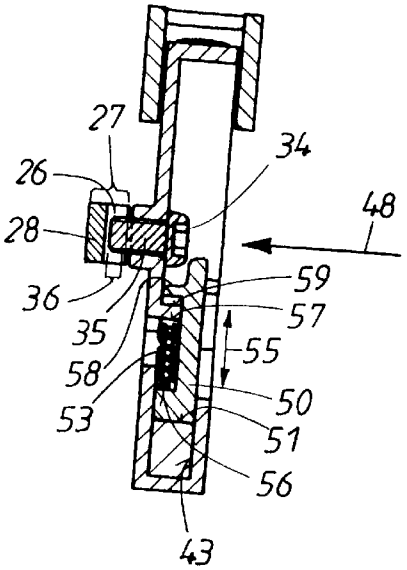
FIG. 6 shows a longitudinal section along the section line VI—VI of FIG. 5 of a bearing arm which is supported on the carrier, wherein additional elements have been omitted.

This lock cylinder 46, mounted in the carrier 40, covers areas of the bearing arm 42 positioned in the area of the coupling receptacle 43 so that manipulations in the area of the bearing arm 42 from the narrow side of the carrier 40, as illustrated by the arrow 47 in FIG. 3, are not possible. Manipulations in an area illustrated by the arrow 48 in FIG. 3 are, however, possible when the bearing arm 42 on the carrier is in a special mounting position which is illustrated particularly in FIG. 5 where it is illustrated by an auxiliary line 42.1. This manipulation 48 is carried out, as illustrated in FIGS. 4 and 6, by means of a tool penetrating through a hole 15 in the door folding 14 of the outer door panel 13. When the mounting position 42.1 of FIG. 5 is present, as illustrated in the sectional view of FIG. 6, the actuation end 34 of an adjusting screw 35 is accessible which has to fulfill several functions to be described in the following.

Figure 5:
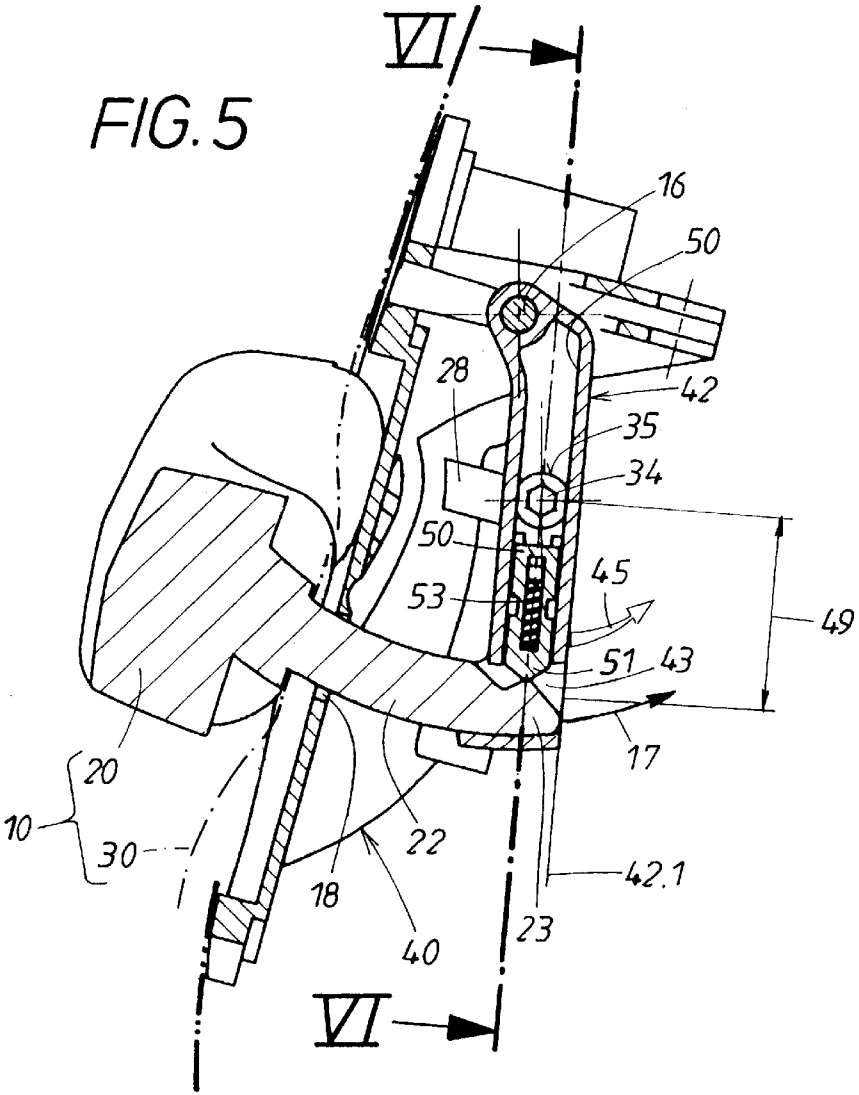
FIG. 5 shows in cross-section along the section line V—V the combined kit of FIG. 4 in the initial phase of the coupling movement of its two modular units, wherein additional elements of the kit which would be interfering with the view have been omitted.

The first function of the adjusting screw 35 is to secure the aforementioned mounting position 42.1 of the bearing arm 42 according to FIGS. 5 and 6. The bearing 41 of the bearing arm 42 is defined by a bearing bolt 16 shown in FIG. 3. As already mentioned, a spring force 45, illustrated in FIG. 5, acts on the bearing arm 42 which usually has the tendency to transfer the bearing arm into the already mentioned rest position which is illustrated by a corresponding auxiliary line 42.0 in FIG. 9. The adjusting screw 35 has a first screw section 36 which cooperates with a stationary projection 26, illustrated best in FIG. 6, which belongs to the carrier 40. This situation can be seen also in the plan view of FIG. 4 wherein elements which would interfere with viewing the parts in question have been omitted. The projection 26 is comprised of an undercut head 27 of a hook 28 which is attached to the carrier 40. In the mounting position 42.1 of the bearing arm 42 the screw section 36 is thus positioned springily on the undercut 26 of the hook head 27.

Figure 1:
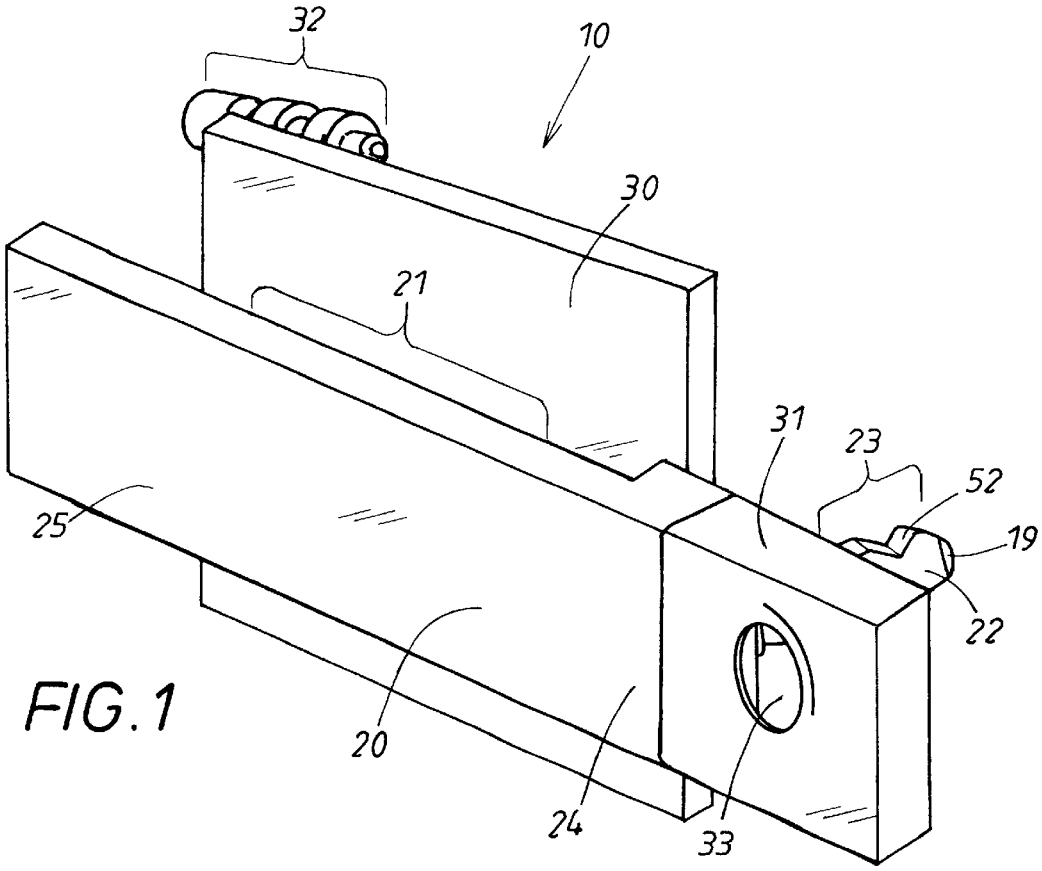
FIG. 1 shows a perspective front view of a modular unit comprised of a handle with a pre-mounted recessed shell.
Figure 2:
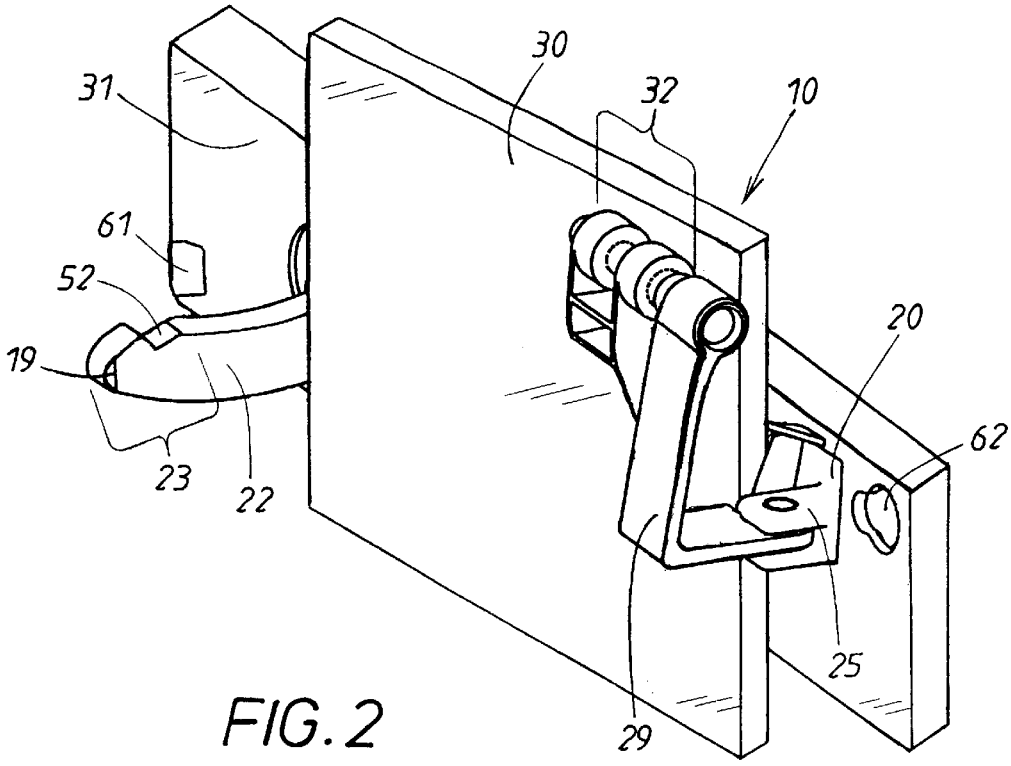
FIG. 2 shows a perspective rear view of the modular unit of FIG. 1.

FIGS. 1 and 2 show that the handle 20 has a shaft 22 at one handle end 24 which extends in the pivot movement direction. The other, oppositely arranged handle end 25, as illustrated particularly well in FIG. 2, is connected by an extension arm 29 to the already mentioned second bearing 32 which is positioned on the backside of the recessed shell 30. This provides the connection between the handle 20 and the recessed shell 30 of the modular unit 10. As can be seen in FIG. 2, the shaft 22 penetrates a cutout in the cover 31 of the recessed shell and projects from the backside of the recessed shell 30. When mounting the handle 20, the entire modular unit 10 is manipulated in a way that will be explained in more detail in the following in connection with FIGS. 5 through 10.

While the second bearing 32 for the handle 20 is already present in the modular unit 10, in the initial situation according to FIG. 3 the first bearing 41 for the handle 20 is initially inactive because it is integrated into the carrier 40 in the present embodiment. This first bearing 41 will become activate in connection with the handle 20 by a coupling action whose initial phase is illustrated in FIGS. 5 and 6. For this purpose, the modular unit 10 is manipulated such that the shaft 22 of the handle 20 is inserted through a hole 18 in the carrier 40 in the direction of an insertion movement illustrated by the arrow 17 of FIG. 5. When this insertion movement 17 is carried out, the end 23 of the shaft 22 moves into the interior of the coupling receptacle 43 of the bearing arm 42 of the carrier. The shaft end 23 thus functions as a "coupling plug" which is provided at its tip with suitable insertion slants 19.

During this insertion movement 17, the coupling plug 23 cooperates with a locking member 50. The locking member 50 is moveably arranged within the bearing arm 42 and loaded by a spring 53. The locking member 50 has the tendency, as a result of the spring load 53, to penetrate with its active locking location 51 into the coupling receptacle 43 on the bearing arm 42. The locking member 50 is comprised in the present case of a slide 50 which is longitudinally movable in the direction indicated by the arrow 55 in FIG. 6 in a guide 54 that extend in the direction of the bearing arm 42. The spring load is provided by a coiled pressure spring 53 which is secured with one end on a moveable shoulder 56 and with the other end on a stationary shoulder 57 on the bearing arm 42. The maximum insertion position of the locking location 51 in the coupling receptacle 43 is determined by a stop 58 which is moveable the slide 50 which, in this case, rests against a stationary counter stop 59 on the bearing arm 42.

Figure 8:
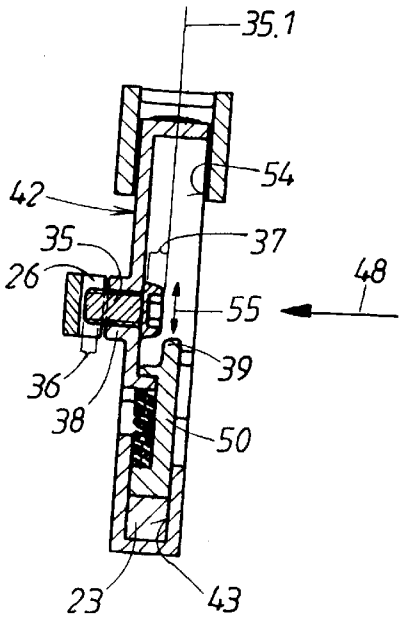
FIG. 8 shows in a longitudinal section view corresponding to FIG. 6 the modular units after completion of the coupling process, wherein the bearing arm is still in the mounting position.
Figure 7:
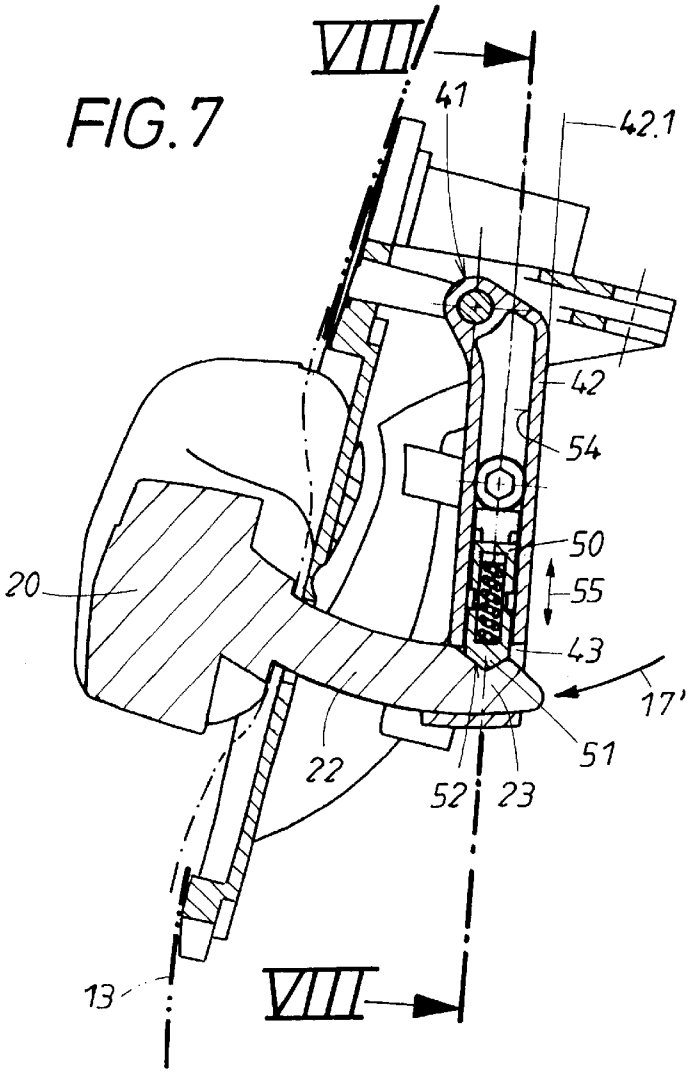
FIG. 7 shows in a sectional view corresponding to FIG. 5 the modular units after completion of the coupling process, wherein the bearing arm is still in the mounting position.
Figure 10:
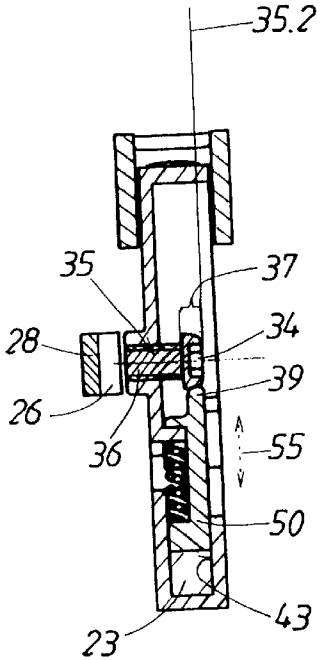
FIG. 10 shows in a longitudinal section view analog to FIG. 6 the rest position of the handle on the attached carrier, wherein the coupling engagement of the two modular units is secured by a locking device.

FIGS. 7 and 8 show the coupling position between the coupling receptacle 43 on the arm and the coupling plug 23 on the shaft 22. The coupling position is determined in that the locking location 51 on the slide engages the counter locking location 52 on the shaft. In the present case, the locking location 51 is a locking projection and the counter locking location 52 is a locking recess. During the aforementioned coupling action 17, the locking projection 51 passes across the raised portion in front of the locking recess 52 in the shaft so that the slide 50 carries out the described longitudinal movement 55 in its guide 54. However, this is possible only, as illustrated in FIG. 8, because the second screw section 37 of the adjusting screw 35 is positioned outside of the movement path 55 of a stepped slide end 39. The adjusting screw 35 is received in a threaded receptacle 38 of the bearing arm 42. The adjusting screw 35 is adjustable between two end positions. The first end position, illustrated in FIG. 8 by means of the auxiliary line 37.1, is present during coupling 17 or counter coupling of the handle 20 and will be referred to in the following for reasons which will become clear later as the "release position". This release position 35.1 determines at the same time the aforementioned mounting position 42.1 of the bearing arm 42. The latter results because of the already described engagement of the first screw section 36 on the stationary projection 26.

Figure 9:
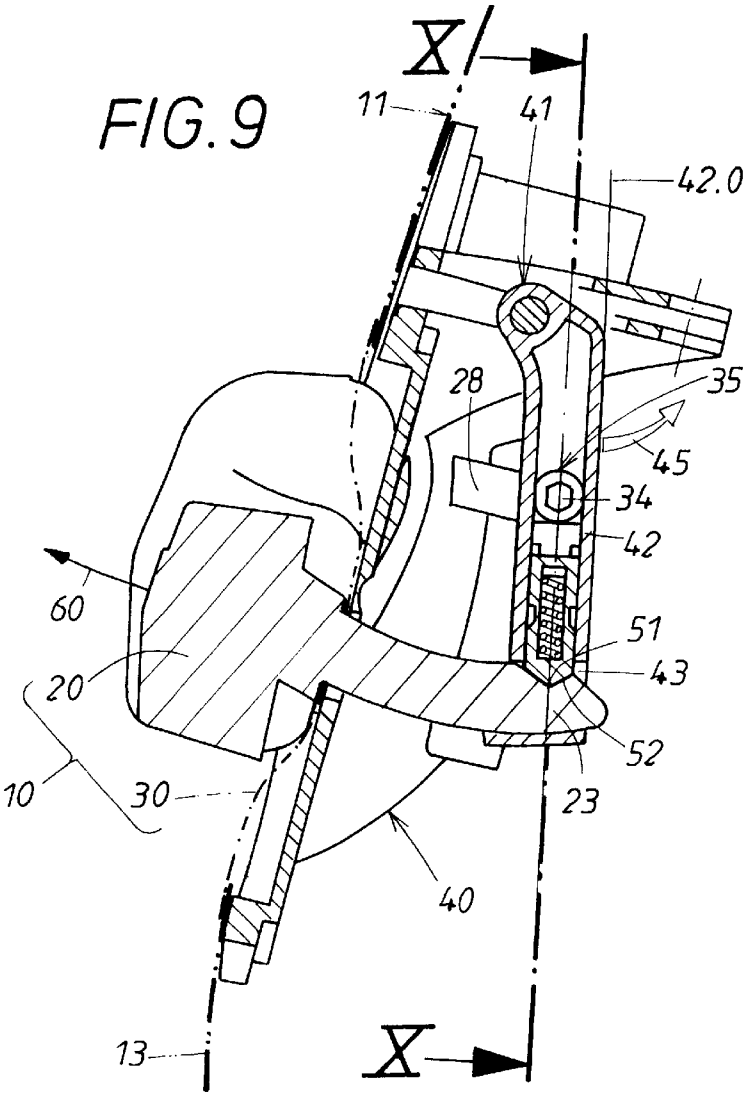
FIG. 9 shows in a section view analog to FIG. 5 the rest position of the handle on the fastened carrier, wherein the coupling engagement of the two modular units is secured by a locking device.

After completed coupling of the coupling plug 23 of the shaft in the coupling receptacle 43 of the arm according to FIGS. 7 and 8, the mounting position 42.1 is canceled. This is realized by the measures illustrated in FIGS. 9 and 10. These measures include, as already described, a tool which, based on the mounting position 42.1 of FIG. 7 and 8, is inserted through the hole 15 in the door folding 14 of FIG. 4 in the direction of arrow 48 and impacts on the actuation end 34 of the adjusting screw 35. By means of the tool the adjusting screw 35 can then be moved into the second position illustrated in FIG. 10 by the auxiliary line 35.2. The screw section 36 is then removed so far that the adjusting screw 35 no longer engages the undercut 26 of the hook 28. The bearing arm 42 is free and is thus transferred as a result of the spring load 45 acting on it into the rest position of FIG. 9 illustrated by the aforementioned auxiliary line 42.0. The handle 20 is then inserted to the maximum extent and is secured by end stops in this rest position. The recessed shell 30 of the modular unit 10 belonging to the handle 20 is now in its final position where it can be secured by fastening means at the locations 61 and 62 illustrated in FIG. 2 on the carrier 40. Now the final attachment position of the modular unit 10 on the exterior side 11 of the door is present. The handle 20 is then not only pivotable on the bearing 32 at the recessed shell of FIG. 2 but also by means of the bearing arm 42 on the bearing 41 of the carrier.

Both bearings 32, 41 determine the pivot axis of the handle 20. The handle 20 can then be manipulated relative to the stationary recessed shell 30 and the carrier 40 in the actuation direction of arrow 60 of FIG. 9. When carrying out this actuation 60, the bearing arm 42 coupled with the handle 20 is pivoted into a working position, not illustrated in detail. This pivot movement of the bearing arm 42 is transmitted via a lever onto a linkage which engages a location identified at 63 in FIGS. 3 and 4. The linkage in the present case is a Bowden cable connected to the location 63 which leads to lock members not illustrated in detail. These lock members are released upon actuation (arrow 60), and the door can be opened.

In the rest position 42.0 of the bearing arm 42 the actuation end 34 of the adjusting screw 35 is no longer accessible without problems through the aforementioned hole 15 in the door folding 14. Moreover, the adjusting screw 35 is then in the position 35.2 and has the additional function of locking the coupling engagement of the plug 43 in the receptacle 43 on the arm. Therefore, this position 35.2 of the adjusting screw 35 is referred to as the "arresting position". This is realized in that the screw section 37 at the head, according to FIG. 10, projects into the movement path of the slide 50 illustrated by the dotted arrow 55. This is realized in that the screw head of the stepped upper slide end 39 is engaged. The slide 50 is locked and, accordingly, the engagement of the locking projection 51 in the locking recess 52 is secured.

Inasmuch as the rest position 42.0 of the actuation end 34 of the adjusting screw 35 should be accessible from the hole 15 in the door folding, this is of interest for initiating a simple demounting of the handle 20. It is then possible, based on the rest position 42.0 illustrated in FIG. 10, to already adjust the adjusting screw 35 such that it moves from its arresting position 35.2 of FIG. 10 into the release position 35.1 illustrated in FIG. 8. The screw section 36 is then again in the extended position illustrated in FIGS. 6 and 8, but engages in this rest position 42.0 of FIGS. 9 and 10 not yet the afore described hook head 27 shown in FIG. 4. The screw section 36 also illustrated in FIG. 4 is still above the hook head 27. This hook head 27 is provided with a slanted portion 64 and the corresponding shaft of the hook 28 is elastic and springy. When the handle 20 is pulled slightly in the actuation direction of arrow 60 of FIG. 9, the projecting screw section 36 in FIG. 4 moves across the slanted portion 64 of the hook head 27, snaps into place behind the undercut 26 of the hook, and reaches the position illustrated in FIG. 4. This is again the mounting position 42.1 of the bearing arm according to FIGS. 7 and 5. A decoupling of the coupling plug 23 of the shaft from the coupling receptacle 43 on the arm in the direction of arrow 17' of FIG. 7 is possible. This is made possible again by the free longitudinal movability 55 of the slide 50. The screw head 37, which in FIGS, 9 and 10 still presents an obstacle, is again in the release position 35.1 of FIG. 8. This position 35.1 is defined by the contact of the screw head 37 on the bottom of the slide guide 54. The stepped slide end 39 is released.

While specific embodiments of the invention have been shown and described in detail to illustrate the inventive principles, it will be understood that the invention may be embodied otherwise without departing from such principles.

What is claimed is:

1. A kit for an external door handle for vehicles, the kit comprised of:

a carrier configured to be fastened at an inner side of a door on an outer door panel;

a handle configured to be mounted on the carrier from an exterior side of the door, wherein the handle, after mounting on the carrier, is pivotably supported and has one handle end provided with a shaft configured to be inserted through a cutout provided in the exterior door panel;

wherein the carrier has a pivotable bearing arm with a coupling receptacle for supporting the handle;

wherein the shaft end of the handle has a coupling plug configured for engaging the coupling receptacle of the bearing arm during mounting of the handle;

a locking device arranged in a coupling area of the coupling plug and the coupling receptacle, wherein the locking device is accessible through a hole in a door folding of the exterior door panel and is configured to secure in a locking position the coupling plug and the coupling receptacle in a coupling engagement for coupling the handle and the bearing arm;

wherein the bearing arm has a movable locking member which is spring-loaded and has a locking location;

wherein the coupling plug has a counter locking location for the locking location of the locking member provided on the shaft end of the handle;

wherein the locking device is comprised of an adjustable obstacle which in the locking position of the locking device projects into the restoring path of the locking member and locks the locking member in locking engagement with the counter locking member of the coupling plug.

2. The kit according to claim 1, wherein the locking member is a longitudinally movable slide and wherein the bearing arm has a guide for the longitudinally movable slide.

3. The kit according to claim 2, wherein the guide extends in a longitudinal direction of the bearing arm.

4. The kit according to claim 2, wherein the slide has a shoulder movable with the slide and the bearing arm has a stationary shoulder, wherein a spring member is arranged between the shoulder on the slide and the shoulder on the bearing arm and wherein the spring member exerts a locking force onto the slide acting in a direction effecting the locking engagement.

5. The kit according to claim 4, wherein the slide comprises a stop movable with the slide, wherein the stop, as a result of being loaded by the spring member, cooperates with a counter stop of the bearing arm and determines a maximum insertion position of the locking location of the slide in the coupling receptacle.

6. The kit according to claim 1, wherein the obstacle is located on the bearing arm and is arranged at a spacing from the coupling receptacle.

7. The kit according to claim 1, wherein the obstacle additionally secures the bearing arm in a defined pivot position which is a mounting position of the bearing arm, wherein the mounting position optimizes at least one of the actions of mounting of the handle relative to the carrier, demounting of the handle relative to the carrier, and accessing the obstacle via the hole in the door folding.

8. The kit according to claim 7, wherein the obstacle is adjustable between an arresting position, in which the locking engagement and the coupling engagement are secured but the bearing arm is released to perform a pivot movement, and a release position, in which the locking engagement is not secured and coupling and decoupling of the handle is possible but the mounting position of the bearing arm on the carrier is fixed.

9. The kit according to claim 8, wherein the obstacle is an adjusting screw and wherein the bearing arm has a threaded receptacle for receiving the adjusting screw, wherein a first end of the adjusting screw is configured for screw actuation of the adjusting screw and is accessible in the mounting position via the hole in the door folding.

10. The kit according to claim 9, wherein the adjusting screw has a first screw section which cooperates in a first screw position, defining a release position of the locking device, with a projection of the carrier to determine the mounting position of the bearing arm, wherein the adjusting screw has a second screw section which in a second screw position, determining the locking position of the locking device, projects into the movement path of the locking member and secures the coupling engagement of the handle and the bearing arm.

11. The kit according to claim 10, wherein the bearing arm is force-loaded in a direction of a folding movement of the handle against the exterior door panel, wherein the projection is comprised of a hook head which is undercut in a counter direction to the folding movement, wherein the first screw section in the first screw position engages the undercut and determines the mounting position of the bearing arm.

12. The kit according to claim 1, wherein the first end of the adjusting screw is accessible only in the mounting position of the bearing arm through the hole in the door folding.

13. The kit according to claim 1, wherein the handle has correlated therewith a recessed shell in a manipulation area of the handle, wherein the recessed shell, in a mounted state on the exterior side of the door panel, rests on the exterior side and is anchored on the carrier, wherein the handle forms with the recessed shell a pre-mounted modular unit but is movable relative to the recessed shell anchored on the carrier, wherein in the modular unit the handle has a bearing on the recessed shell, and wherein the bearing on the recessed shell and the bearing arm are located on opposed ends of the handle.

14. The kit according to claim 12, wherein the shell has a cover for a lock cylinder received in the carrier.

* * * * *